United States Patent [19]
Gallagher

[11] 4,296,992
[45] Oct. 27, 1981

[54] ELECTRICAL CONNECTOR ASSEMBLY

[75] Inventor: David A. Gallagher, Romeoville, Ill.

[73] Assignee: Bunker Ramo Corporation, Oak Brook, Ill.

[21] Appl. No.: 28,156

[22] Filed: Apr. 9, 1979

Related U.S. Application Data

[63] Continuation-in-part of Ser. No. 836,325, Sep. 26, 1977, Pat. No. 4,154,496.

[51] Int. Cl.[3] ..... H01R 13/506
[52] U.S. Cl. ..... 339/186 M; 339/206 R
[58] Field of Search ..... 339/89 R–90 C, 339/103 B, 107, 59 M, 206 R, 206 P, 126, 128

[56] References Cited

U.S. PATENT DOCUMENTS

| | | | |
|---|---|---|---|
| 3,097,905 | 7/1963 | Shearer et al. | 339/89 M X |
| 3,588,150 | 6/1971 | Wold | 285/381 |
| 3,646,502 | 2/1972 | Hutter et al. | 339/177 E X |
| 3,732,527 | 5/1973 | McKnight | 339/89 M X |
| 3,816,641 | 6/1974 | Iversen | 339/89 R X |
| 3,855,566 | 12/1974 | Richardson | 339/89 M X |
| 3,930,705 | 1/1976 | Gallagher | 339/59 M |
| 4,007,953 | 2/1977 | Powell | 339/89 R X |
| 4,033,535 | 7/1977 | Moran | 339/103 B X |
| 4,037,909 | 7/1977 | Trompeter et al. | 339/90 C X |
| 4,068,911 | 1/1978 | Lodato et al. | 339/90 R |
| 4,074,927 | 2/1978 | Ball | 339/89 M |
| 4,154,496 | 5/1979 | Gallagher | 339/89 M X |

FOREIGN PATENT DOCUMENTS 1500102 2/1978 United Kingdom .

*Primary Examiner*—Eugene F. Desmond
*Attorney, Agent, or Firm*—F. M. Arbuckle; B. W. Sufrin

[57] ABSTRACT

The invention is a connector assembly consisting of an elastomeric insert member held within a rigid shell by a retaining ring which engages both the shell and the insert. The assembly includes a passageway between the insert member and the shell permitting access to the retaining ring to allow ready disengagement of the ring and insert from the shell. The retaining ring is composed of two half sections which close about the insert member. The ring includes first retention means for engaging and maintaining the insert member in fixed position within the ring. The first retention means may consist of protuberances extending radially inward from the retaining ring to engage the insert member or it may comprise keying means configured to prevent both axial and rotational movement of the insert member relative to the retaining ring. The retaining ring also includes radially movable second retention means for engaging the shell to maintain the ring and insert member in fixed axial position within the shell. The second retention means constitutes flexible arms extending axially from the ring and having lips disposed at the extremity of each arm. The lips include cam surfaces aligned with the passageway to facilitate disengagement of the ring and insert member from the shell by the action of a cylindrical tool which may be inserted into the passageway to disengage the lips from the shell.

16 Claims, 13 Drawing Figures

40
B
50
36
A
38
A'
36
50
42
B'

52
54
46
44
40

6
5
40
44
50
A
38
A'
44
50
42
5
B
36
36
B'
4
6
4
57
57
53
46
46
53
54
54
46
46

B
40
A
38
A'
B'
50
50
36
36

ELECTRICAL CONNECTOR ASSEMBLY

This is a continuation-in-part of U.S. Application Ser. No. 836,325 filed Sept. 26, 1977, now U.S. Pat. No. 4,154,496.

BACKGROUND OF THE INVENTION

The present invention relates generally to electrical connectors and, more particularly, to electrical connector assemblies in which an elastomeric insert member is mounted within a generally rigid shell or housing and in which the insert member may be assembled to or disassembled from the shell very quickly and easily while still providing a rugged construction which is also relatively tamper proof.

In recent years, a variety of electrical connectors have been developed which make use of integrally molded rubber and synthetic elastomer inserts. These connectors, due to their one piece construction and use of environmentally resistant materials, are ideally suited for use in the transportation industries and in other applications where it is necessary or desirable to protect the circuitry carried by the connector from ambient conditions. One example of such a prior art connector is that disclosed in U.S. Pat. No. 3,930,705, assigned to the Bunker Ramo Corporation, the assignee of the present application.

Although such environmentally protected prior art connectors have met with considerable commercial success, they nevertheless suffer from certain drawbacks and disadvantages which have limited their usefulness in some applications. First of all, it is difficult to rigidly mount an elastomeric molded connector to a panel or other support surface by the use of an integrally molded flange or mounting element, since the materials from which the connectors are molded are not suited for this purpose. Second, presently available non-integral mounting elements have numerous drawbacks, especially in those applications where the mounted connectors are subjected to mechanical abuses. For example, the elastomeric molded connectors may on occasion be dislodged from the non-integral mounting elements. On the other hand, when it is desired to remove the elastomeric molded connectors from their non-integral mounting elements, the required disassembly procedure is usually difficult. Finally, many present non-integral mounting elements have been found to interfere with mating of the elastomeric molded connector plug and receptacle portions.

SUMMARY OF THE INVENTION

Significant advantages over prior elastomeric molded connector mounting systems are achieved by the present connector assembly in which an elastomeric molded connector insert is locked within a rigid shell. The rigid shell which protects the insert from mechanical abuse and environmental conditions is adapted for mounting to panels or to other supporting surfaces. The molded insert is easily and firmly fixed within the shell by means of a retaining ring which engages both the insert and the shell. Engagement of the ring with the shell is accomplished by radially movable retention means. The retaining ring produces a tight, tamper proof interengagement between the shell and the insert which nevertheless may be readily released with a simple tool which is inserted through a passageway provided in the connector assembly.

In a preferred embodiment, the retaining ring is made of two half ring sections joined by a living hinge. In the complete shell, ring and connector assembly, the half ring sections from an annular element in which the ring sections are held in place by the cooperation of the outer shell and the inner elastomeric connector. As discussed further below, the preferred retaining ring may be adapted to be retrofitted to standard elastomeric molded connectors or inserts or it may be fitted to specially modified elastomeric molded inserts.

In summary, the present invention is directed to a connector assembly comprising a shell and elastomeric insert member for supporting at least one electrical contact and a retaining ring. The connector assembly includes, in addition to the shell insert and ring, a passageway permitting disengagement of the assembly. The retaining ring includes a first retention means for engaging and maintaining the insert member in fixed position within the ring. The retaining ring also includes a radially movable second retention means for engaging the shell to maintain the ring and insert member in fixed axially position within the shell. The assembly may be easily dismantled by insertion of a simple tool through a passageway which provides access to the second retention means, thereby permitting disengagement of the ring and insert member from the shell.

It is therefor an object of the present invention to provide an improved mounting system for rigidly mounting elastomeric molded connectors or connector inserts to panels or other support surfaces.

It is a further object of the present invention to provide a mounting element which can be readily fitted to either standard or specially adapted elastomeric molded connectors to firmly hold the connectors in a tamper-proof manner whereby the mounting element can be readily separated from the connector by the application of an appropriate tool.

It is yet another object of the present invention to provide a mounting system for elastomeric molded connectors which does not interfere with mating of the connector plug and receptacle portions but which will not be readily separated from the connectors when they are subjected to mechanical abuses.

It is yet another object of the present invention to provide a mounting system for elastomeric molded connectors which will protect the connectors themselves from physical abuse and adverse environmental conditions.

Other objects and features of the invention will become apparent upon examination of the following specification and drawings together with the claims. While the invention is described below in connection with preferred or illustrative embodiments, these embodiments are not intended to be exhaustive or limiting of the invention. Rather, the invention is intended to cover any alternatives, modifications, and equivalents that may be included within its spirit and scope as defined by the appended claims.

BRIEF DESCRIPTION OF THE DRAWINGS

The invention, together with further of its objects and attendant advantages, will be best understood by reference to the following description taken in connection with the accompanying drawings in which.

Similar reference numerals are applied to corresponding features throughout the different figures of the drawings.

DETAILED DESCRIPTION OF THE INVENTION

Turning now to the drawings, there is illustrated a connector assembly 10 comprising a shell 12, an elastomeric moldable connector or insert member 14 and a retaining ring 16.

Figure 10:
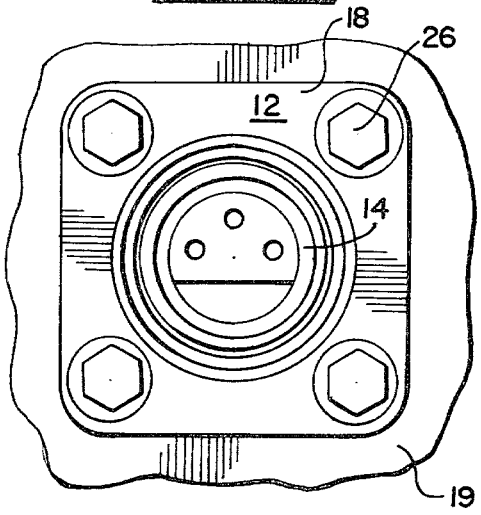
FIG. 10 is an end view of the mounted connector assembly taken along lines 10—10 of FIG. 9.
Figure 9:
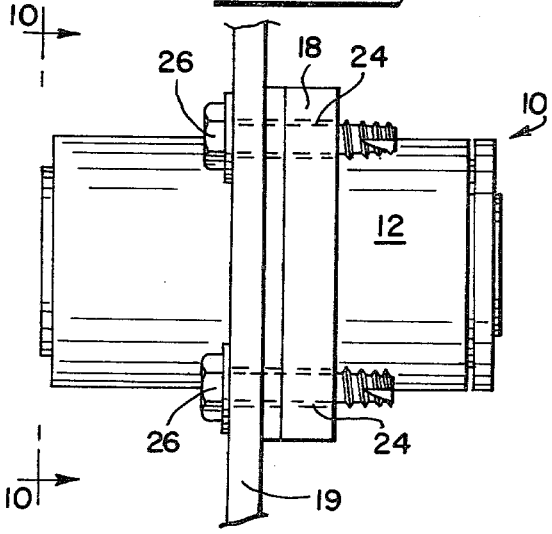
FIG. 9 is a side elevational view of a connector assembly wherein the rigid shell is adapted for mounting to a panel by means of a self threading hexscrews which engage holes in the shell flange.

The shell 12, which is made of a rigid material such as metal or preferably a plastic, is best illustrated in FIGS. 1, 2, 8, 9 and 10. The shell 12 includes a flange 18 designed to abut a panel or other support surface 19 and means for affixing the shell to the panel by drawing the flange against the panel surface. Conventional fastening means can be used for this purpose such as the threaded portion 20 and mating panel nut 22, as illustrating in FIGS. 1 & 8, or a flange with predrilled holes 24 engaged by selfthreading screws 26 which pass through the panel from the side opposite the flange and draw the flange up against the panel as they are tightened, as illustrated in FIGS. 9 and 10. The shell 12 also includes a keyway 27 designed for engaging a key 58 on the ring 16 in order to prevent rotation of the ring and connector 14 within the shell 12.

The shell 12 is provided with an internal annular camming surface C disposed on the inside surface of the shell. As will be discussed further below in connection with the description of the retaining ring 16, this camming surface C is engaged by the radially movable second retention means 46 of the retaining ring as the subassembly D of ring 16 and connector 14 is brought into engagement with the shell 12.

Figure 7:
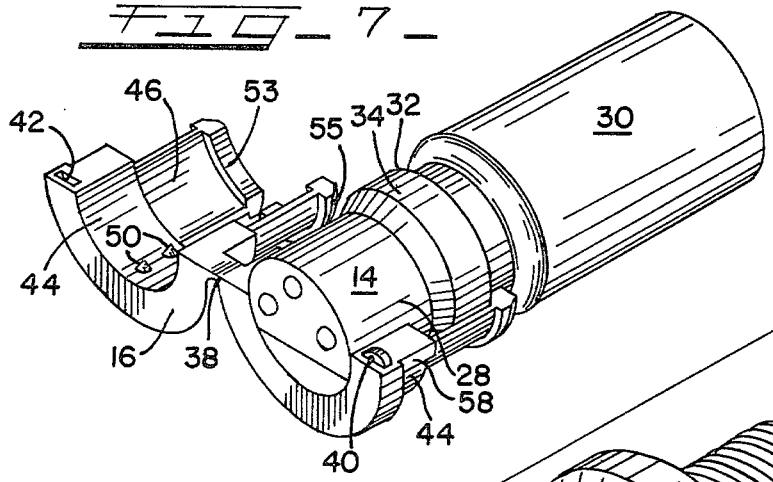
FIG. 7 is a perspective view of an elastomeric connector insert resting in one half of an opened retaining ring.
Figure 8:
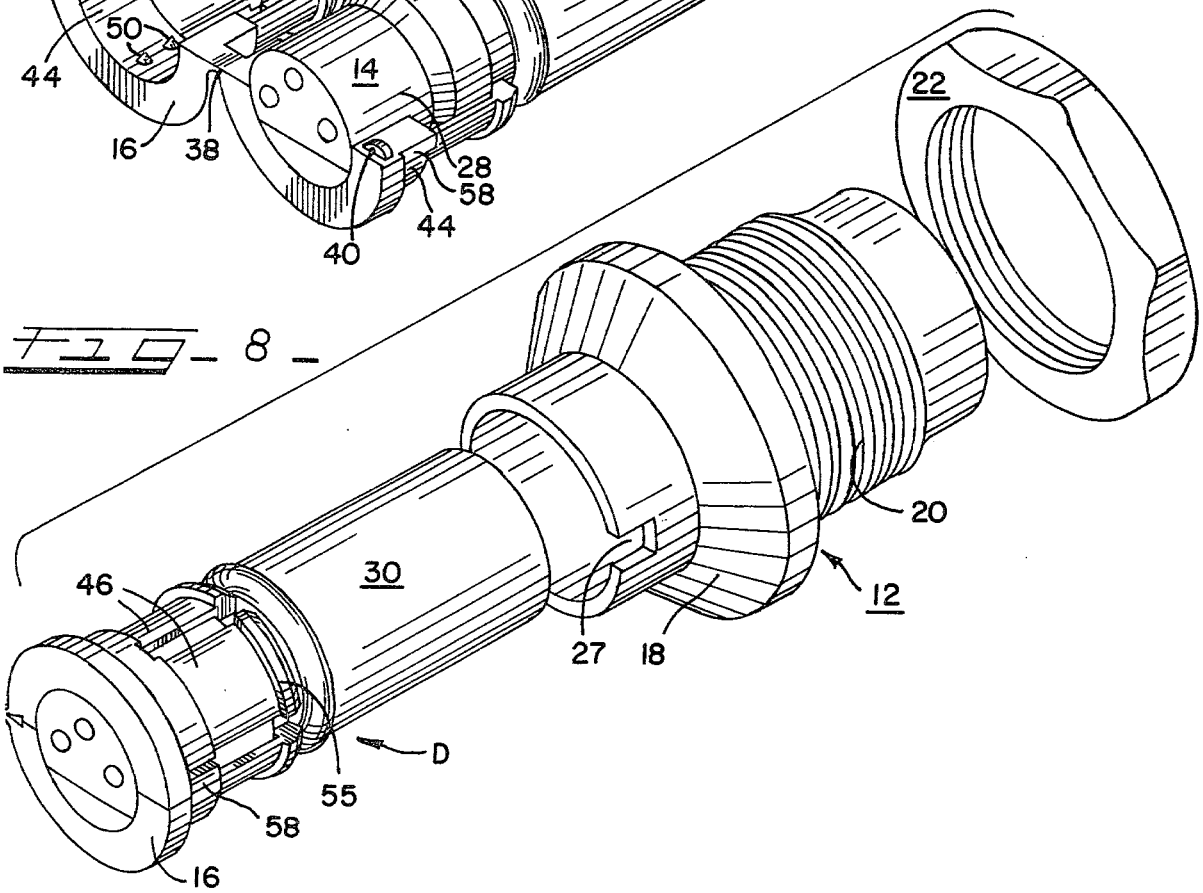
FIG. 8 is an exploded perspective view of a connector assembly including, in addition to the insert and retaining ring assembly depicted in FIG. 7, a shell adapted for mounting in a panel aperture or other support surface by means of a threaded panel nut.

The elastomeric molded connector or insert 14 may be of a conventionally available type such as that described in U.S. Pat. No. 3,940,705 and as best depicted in FIG. 7. The elastomeric connector 14 includes a round base 28 and an annular sleeve 30. Disposed along the round base 28 is an annular collar 34 defining a front shoulder 32 toward its forward or mating end.

The retaining ring 16 comprises two half sections 36 joined by a living hinge 38 which permits the half sections to be pivoted to a closed position to form a tubular or annular component. The faces B and B′ of the half sections 36 are respectively provided with a projection 40 and a corresponding notch 42 for aligning the half sections when they are brought into abutment to form relatively smooth, continuous inner and outer ring surfaces.

The retaining ring 16 is made up of an annular base 44 and second retention means comprising flexible axially extending arms 46. First retention means comprising protuberances or points 50 are disposed on the inner face of the annular base 44, extending radially inward therefrom when the ring half sections 36 are in their closed position. These protuberances 50 grip the insert member 14 in fixed position within the retaining ring 16 within the subassembly D.

Figure 1:
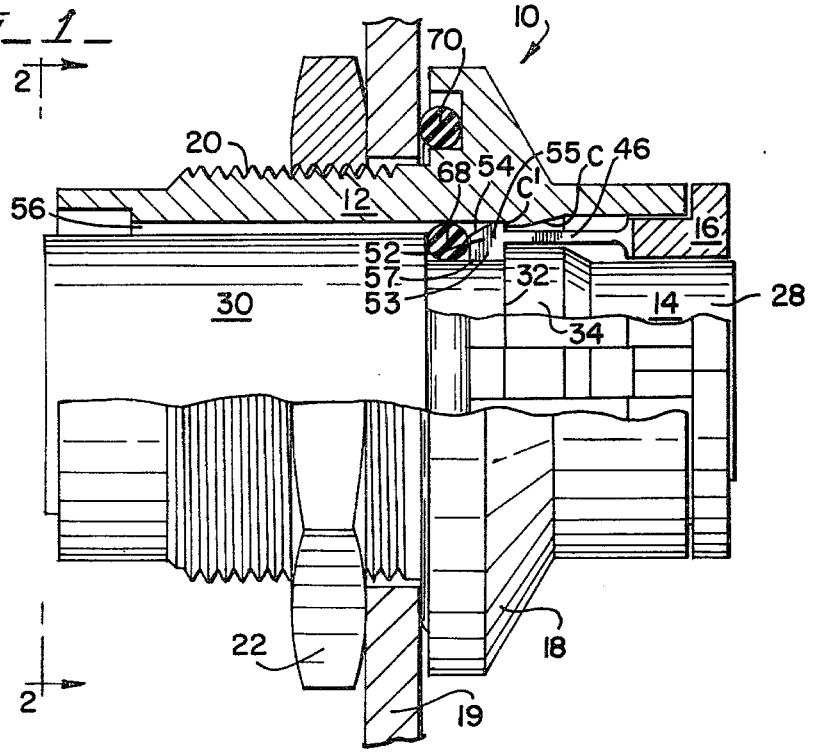
FIG. 1 is a side elevational view, partially in section, of a connector assembly incorporating the principles of the present invention.
Figure 2:
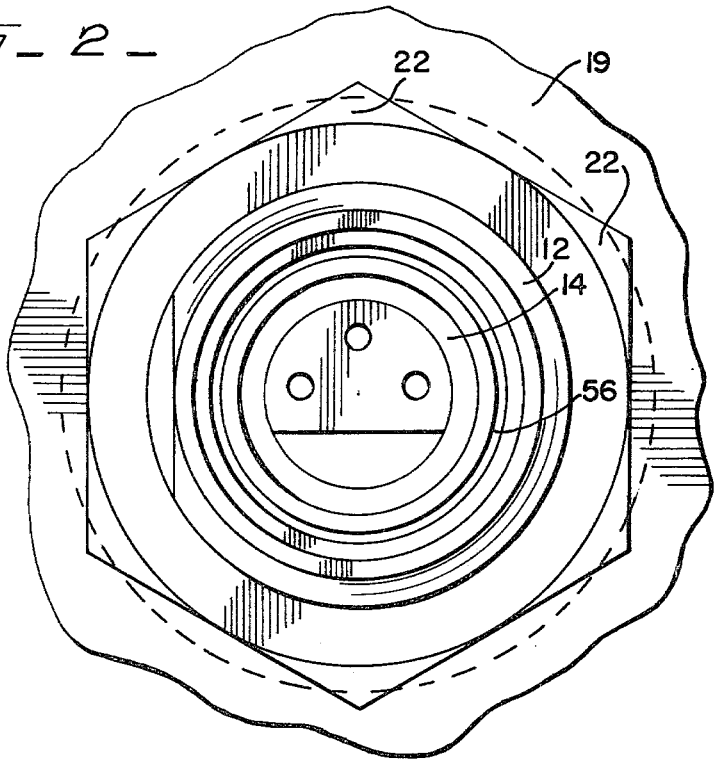
FIG. 2 is an end elevation view of a connector assembly taken along line 2—2 of FIG. 1.
Figure 5:
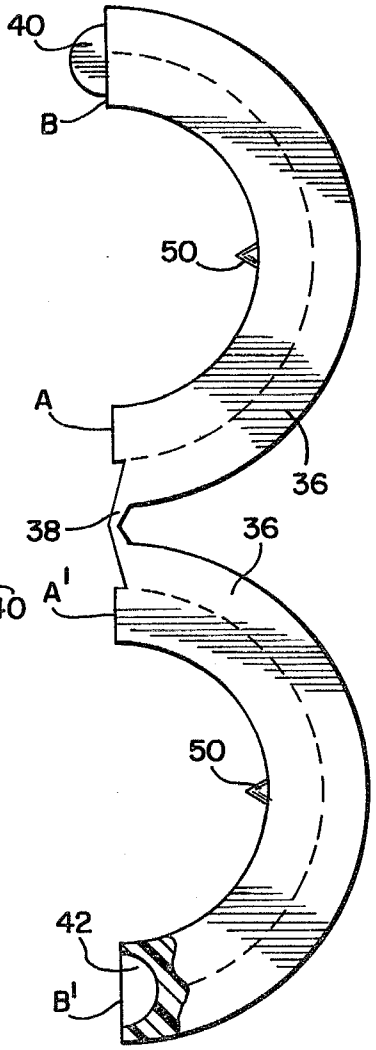
FIGS. 4, 5 and 6 are views of the ring of FIG. 3 taken along line 4—4, 5—5, and 6—6, respectively.
Figure 6:
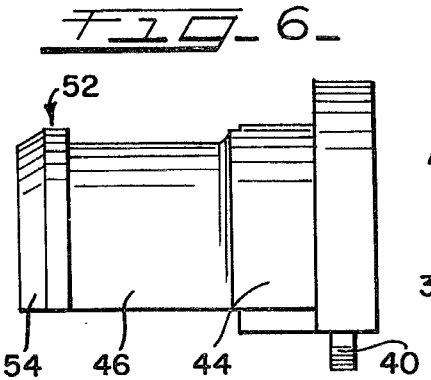
Figure 3:
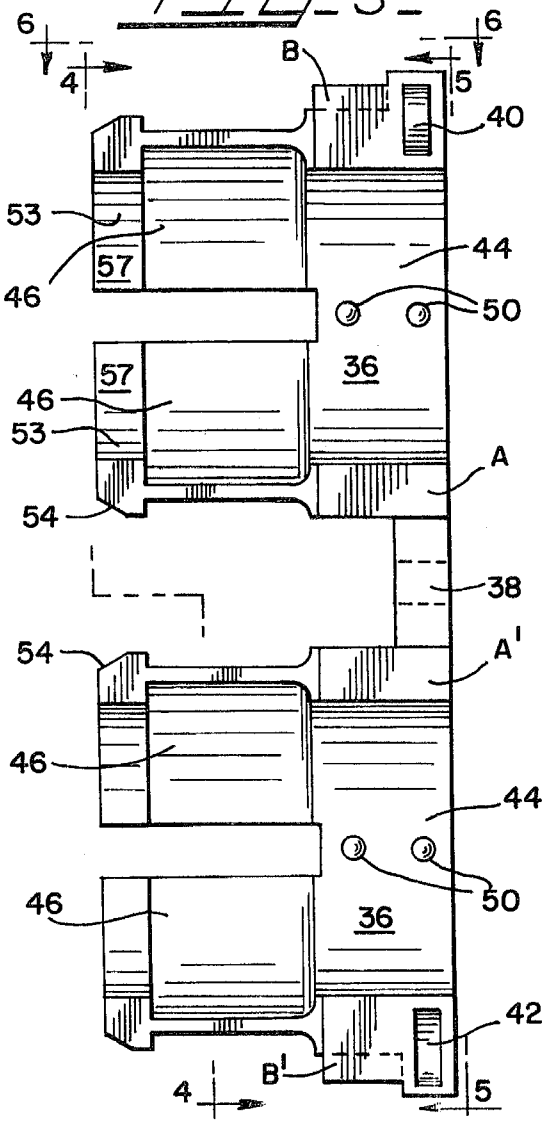
FIG. 3 is an elevational view of the retaining ring of the connector assembly of FIG. 1 wherein the ring is opened about its hinge.
Figure 4:
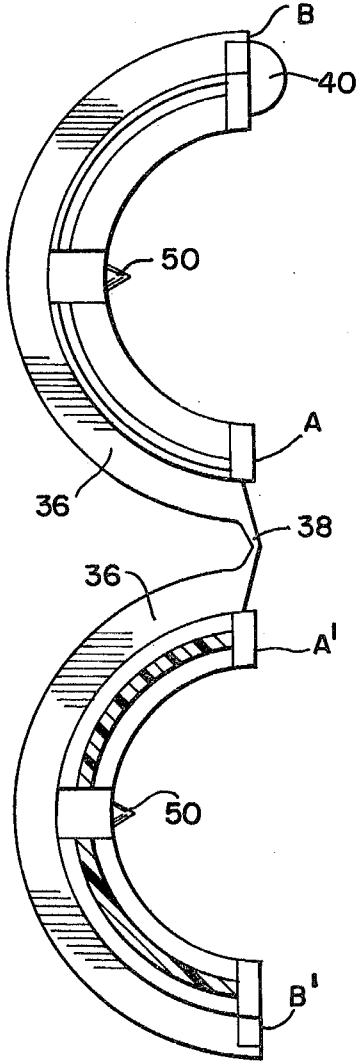

The flexible, axially extending arms 46 of the retaining ring 16 have lips 52 protruding from both the inner and outer surfaces of the distal end of each of the arms, as best illustrated in FIG. 1. When the subassembly D comprising the retaining ring 16 and elastomeric insert 14 is assembled by closing the two half sections 36 of the ring about the connector, the lip portions 53 extending radially inward engage the shoulder 32 of the connector 14. When the subassembly is subsequently assembled into the shell 12, the lip portions 55 extending radially outwardly engage the shell shoulder C. Thus, the axially extending arms 46 with protruding lip portions 53 & 55 and the protruberances 40 together maintain the ring 16 and insert 14 in fixed radial and axial position within the shell 12.

The axially extending arms 46 include a cam surface 54 aligned with the passageway 56 which cooperates with a removal tool (not shown) to disengage the subassembly D of ring 16 and insert member 14 from the shell 12. The method of disengagement of the ring and insert member from the shell will be discussed further in connection with the description below of the passageway 56.

The connector assembly is put together by first forming the subassembly D comprising connector 16 and retaining ring 14, and then interconnecting the subassembly D to the shell 12. The subassembly D is formed by positioning an elastomeric moldable connector 14 within an open retaining ring 16 so that lip portions 55 are aligned with connector shoulder 32. The retaining ring half sections 36 are then closed about the connector 14 to form the subassembly D and then manually held in this position while subassembly D is inserted into the shell 12. As the retaining ring 16 is moved axially into the shell 12, the flexible arms 46 and lips 52 are forced radially inwardly by the action of the shell camming surface C against the lip portion 55 so that the face 57 of the lip portion 53 is first moved into positive contact with the collar 34 and then continues to move radially inward compressing the elastomeric material of the connector base 28. As the lip portion 53 clears the camming surface C, the combined action of the compressed portion of the elastomeric connector base 28 and the flexible arms 46 will "spring" the lip 52 into position at the shoulder C' of the camming surface C to produce a distinct "snap-in" effect. The lip 52, backed up by the spring action of the elastomeric body of the connector collar 34 will firmly engage the shell 12 and connector 14 thereby forming a tamperproof connector assembly As can be readily see in FIG. 1, a passageway 56 is defined between the outer surface of the sleeve 30 of the connector insert 14 and the corresponding inner surface of the shell 12. The passageway 56 is a tubular opening with a diameter and cross-sectional area adapted to permit access to the cam surface 54 of the arms 46. A simple tool comprising, for example, a rigid tube of the appropriate diameter and wall thickness, may be inserted into the connector assembly through the passageway 56 so that it engages the cam surfaces 54 and comes to rest against shoulder C' of camming surface C. The rigid tube thereby forces the lips 52 into the elastomeric material of the collar 34 and permits the subassembly D to be removed from the shell 12 without interference between the shoulder C' of the cam surface C and the lips 46.

The connector assembly may optionally include a resilient gasket such as O-ring 68 to seal the passageway 56 thereby preventing fluids from passing through the shell and enhancing the environmental security of the overall assembly. An additional resilient gasket such as O-ring 70 of FIG. 1 may be interposed between the flange 18 of the shell 12 and the panel 19 to which it is attached.

Figures 11, 12:
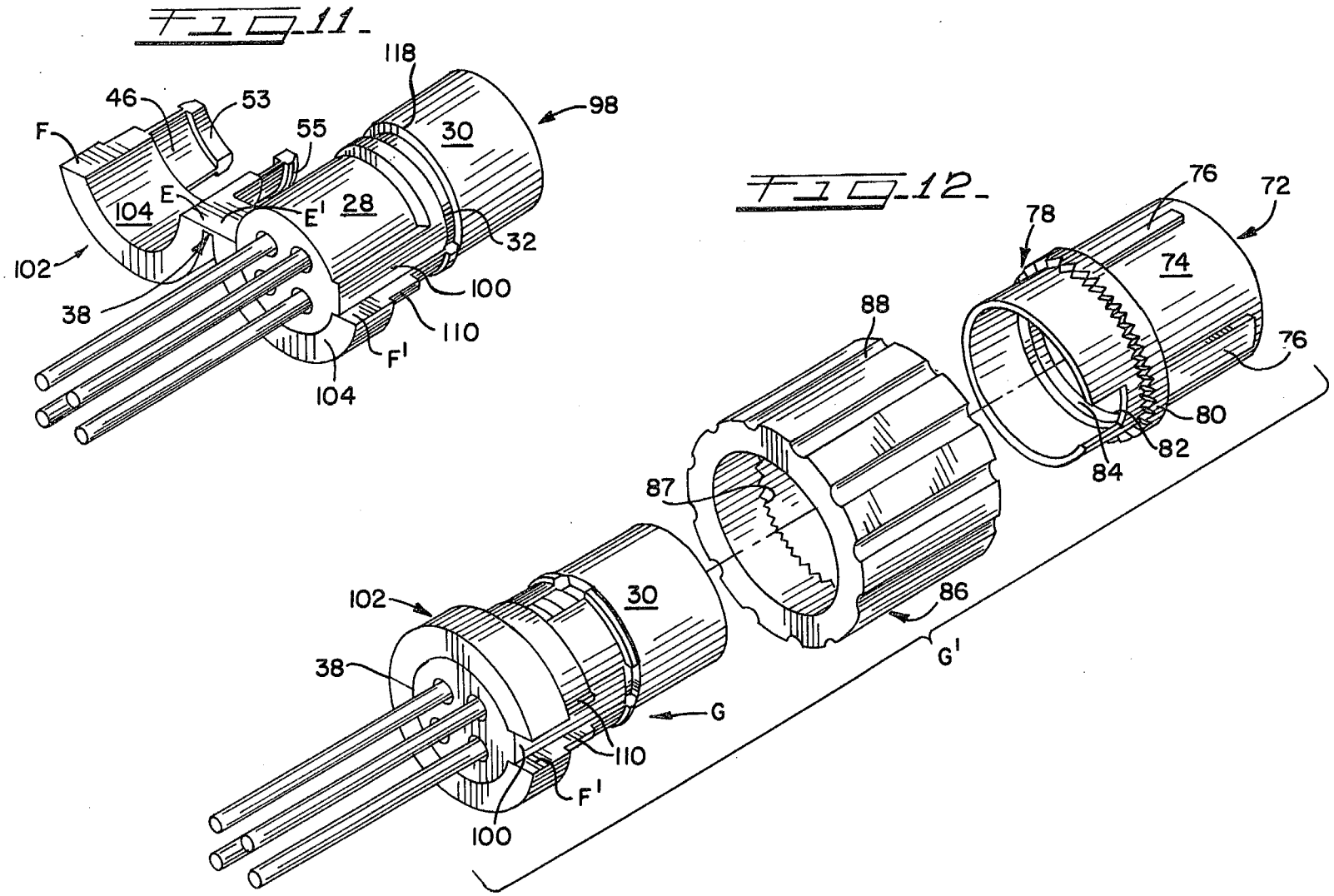
FIG. 11 is a perspective view of a specifically configured elastomeric connector insert resting in one half of an opened retaining ring and including conductors communicating with contacts within the insert.
FIG. 12 is an exploded perspective view of a connector assembly designed to be assembled to a threaded coupling containing a mating connector in which the connector insert and retaining ring assembly of FIG. 11 cooperates with a coupling nut and rigid shell.
Figure 13:
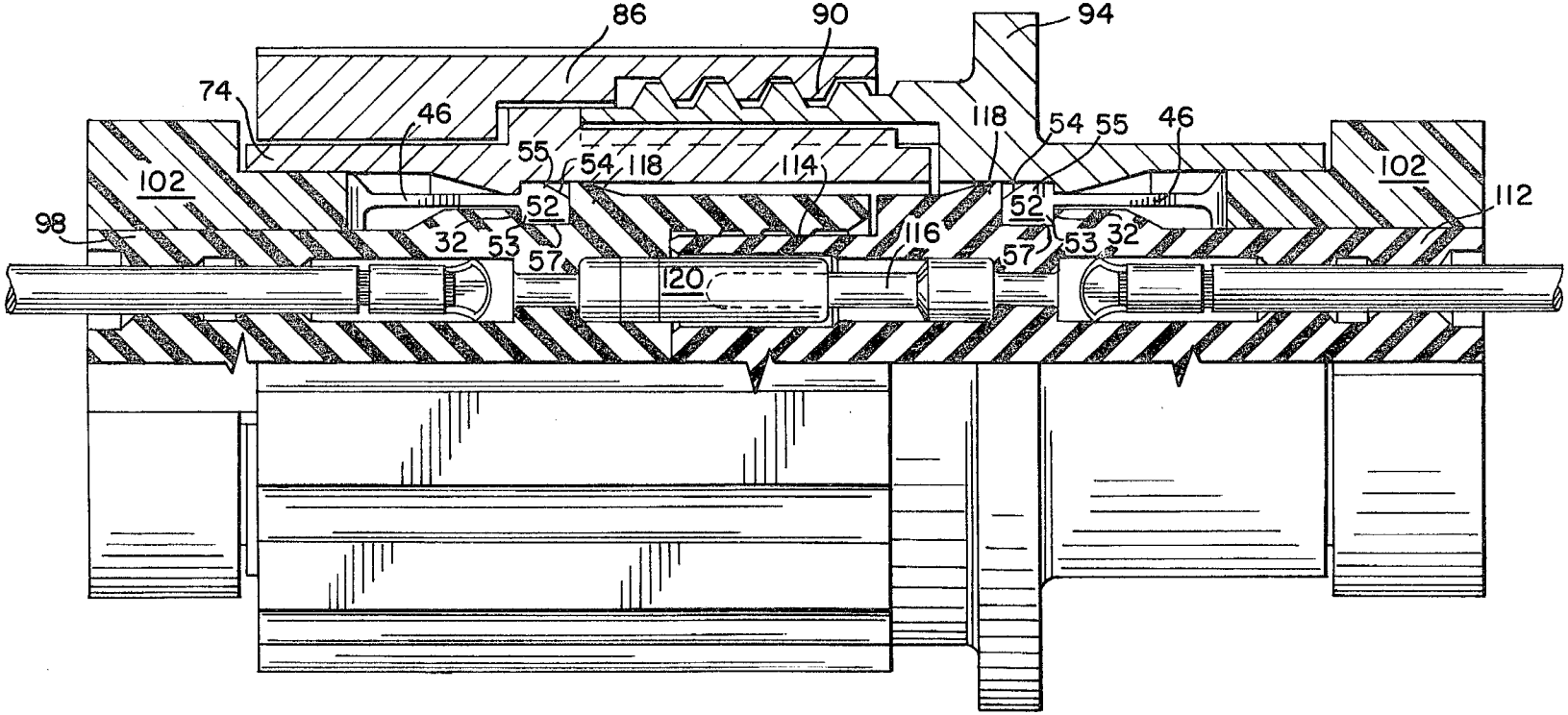
FIG. 13 is a partial sectional view of the assembly of FIG. 12 joined to a threaded coupling containing a complementary mating connector also fitted with a rigid shell and retaining ring.

FIGS. 11, 12 and 13 illustrate an alternate embodiment of the invention in which a specially molded elastomeric connector is utilized in lieu of the standard connector 14 of FIGS. 1–10. The distinguishing aspects of the second embodiment of FIGS. 11, 12 and 13 will be discussed below.

Turning to FIG. 12, there is illustrated a tubular shell 72 made of a rigid material such as metal or plastic having a forward portion 74 carrying shell polarizing keys 76. The shell 72 has a rear portion 78 with an annular rearwardly directed antidecoupling ratchet 80 and a retainer keyway 82. The shell 72 has a retaining shoulder 84 annularly positioned on its inner surface. The shell 72 cooperates with a tubular coupling nut 86, which is also preferably formed from thermoplastic material. The coupling nut 86 has a forwardly directed annular anti-decoupling ratchet shoulder 87 which engages the rearwardly facing antidecoupling ratchet 80 of the shell 72. As is best seen in FIG. 13, the coupling nut 86 also has threads 90 on its inner surface for engaging a threaded coupling and longitudinal outer ribs 88 as shown in FIG. 12 for improved gripping during tightening or loosening of the coupling nut.

A specially molded connector insert 98 having an integrally formed insert polarizing key 100 is depicted most clearly in FIG. 11. The insert 98 is also formed with a special shell seal 118 constituting a radially extending integral sealing rib on the surface of the connector base 28. This annular rib engages the inner wall of the shell 72 to form an environmentally secure seal generally equivalent to that obtained with the O-ring 68 of the prior embodiment.

The retaining ring 102 utilized in the embodiment of FIGS. 11–13 again comprises two half sections 104 joined at one pair of corresponding faces E and E' by a living hinge 38. However, in contrast to the embodiment of FIGS. 1–10, the two half sections 104 are dimensioned to close about the connector 98 with the non-hinged corresponding faces F and F' abuting the insert polarizing key 100. The cooperation of the insert polarizing key 100 of the insert 98 with the faces F and F' of the half sections 104 of the retaining ring 102 prevents rotation of the insert 98 relative to the retaining ring 102. Thus, the need for the protuberances or points 50 of the retaining ring 16 of the embodiment of FIGS. 1–10 is eliminated and the insert 98 is polarized relative to the ring.

The half sections include radially extending retainer key portions 110 which abut the insert polarizing key 100 when the retaining ring 102 is closed about the insert 98. These retainer key portions are configured to be mateable with the retainer keyway 82 of the shell 72. Thus, the insert 98 is keyed to the ring 102 by way of the cooperation between the insert polarizing key 100 of the insert 98 and the half sections 104 of the retaining ring and this assembly in turn is keyed to the receptacle shell by way of the cooperation between the retainer key portions 110 of the retaining ring 102 and the keyway 82 of the shell 72. The mutual cooperation of insert key, retainer key portions and shell keyway makes possible a predetermined and repeatable polarity of connection required in the utilization of multi-contact connectors.

As in the case of the prior embodiment, it is preferable that the retaining ring 102 be closed about the insert 98 and manually held in that position to form first subassembly F. In the present embodiment, however, the coupling nut 86 and shell 72 are next fitted to the first subassembly so that the retainer key portions 110 mate with the retainer keyway 82 and the ratchet 80 of the shell 72 is spaced-apart from the ratchet shoulder 87 of the coupling nut 86 thereby forming an assembly G'. The assembly G' is then connected to the threaded coupling 94 with the assembly G' positioned so that the shell polarizing keys 76 mate with keyways of the threaded coupling 94 as the coupling nut 86 is threaded onto the threaded coupling 94. It should be noted that the cooperation of the shell polarizing keys 76 with the keyways of the threaded coupling makes it possible to maintain the connector 98 in the desired predetermined polarity.

As can best be seen in FIG. 13, the threaded coupling 94 carries a second elastomeric moldable insert 112 for mating with the insert 98 which together form an environmentally secure seal along the seal portion 114. The second insert 112 is mounted within the threaded coupling using a connector assembly again following the teaching of the present invention. As is well recognized in the art, the pin and socket contacts 116 and 120 respectively of the cooperating inserts may be disposed in either connector as required.

I claim:

1. A connector assembly comprising:

a shell;

an elastomeric insert member for supporting at least one electrical contact;

a retaining ring comprising at least two portions which may be opened to receive said insert and closed to permit insertion of said ring and insert member into said shell, said ring including retention means for engaging and maintaining said insert member in fixed position within said ring and a plurality of radially movable axially extending arms for engaging said shell to maintain said ring and insert member in fixed axial position within said shell; and a passageway providing access to said axially extending arms to permit disengagement of said ring and insert member from said shell.

2. The connector assembly of claim 1 wherein said retaining ring comprises two half-sections joined by hinge means, said half-sections being pivotable about said hinge means to close around said insert member.

3. The connector assembly of claim 1 wherein said retaining ring comprises an annular base portion with said plurality of arms extending axially therefrom, each of said axially extending arms having a lip disposed at its distal extremity.

4. The connector assembly of claim 3 wherein each of said lips has a cam surface aligned with said passageway to facilitate disengagement of said axially extending arms from said shell thereby permitting removal of said ring and insert member from said shell.

5. The connector assembly of claim 1 wherein said elastomeric insert member provides a biasing force to urge said axially extending arms into engagement with said shell to prevent inadvertent disassembly of said insert member from said shell.

6. The connector assembly of claim 1 wherein said retaining ring further includes means for maintaining said ring and insert member in fixed rotational orientation within said shell.

7. The electrical connector assembly of claim 1 wherein said retention means comprise at least radially inwardly extending protruberance which engages said insert member.

8. The electrical connector assembly of claim 1 wherein said retention means comprises keying means configured to prevent both rotational and axial movement of said insert member relative to said retaining ring.

9. The electrical connector assembly of claim 1 further comprising a coupling ring mounted for rotation on said shell, said retaining ring and said shell each having abutment means to maintain said coupling ring in fixed axial position on said shell.

10. In an electrical connector assembly having an elastomeric insert member carrying at least one electrical contact and a generally rigid shell for housing said insert member, the improvement comprising:

a retaining ring comprising at least two portions which may be opened to receive said insert and closed to permit insertion of said ring and insert member into said shell;

retention means for maintaining the insert member in a fixed position within said ring;

a plurality of axially extending arms formed integrally with said retaining ring for engaging said shell to maintain said ring and insert member within said shell, said axially extending arms being radially movable to disengage from said shell and thereby permit disassembly of said member from said shell.

11. The improved electrical connector assembly of claim 10 further comprising a passageway to accommodate insertion of a disassembly tool into said assembly to disengage said axially extending arms from said shell.

12. The improved electrical connector assembly of claim 11 wherein said insert member is spaced from said shell along at least a portion of its perimeter thereby forming said passageway.

13. The improved electrical connector of claim 11 further comprising means for sealing the interface between said insert member and said shell, said sealing means being effective to prevent the passage of contaminants through said connector assembly while permitting insertion of said disassembly tool along said passageway.

14. An electrical connector assembly comprising:

a generally rigid shell having an internal shoulder;

an elastomeric insert member supporting at least one electrical contact;

a retaining ring;

first retention means for maintaining the insert member in fixed position within said ring;

second retention means comprising at least one cantilevered resilient arm formed integrally with said retaining ring, each said arm having a lip adjacent its distal extremity for engaging the shoulder of said shell to thereby maintain said insert member and said ring within said shell; and a passageway providing access to said second retention means to permit radially inward movement of said arm extremity and to disengage said lip from said shoulder.

15. An electrical connector assembly comprising:

a rigid shell having an internal shoulder;

an elastomeric insert member for supporting at least one electrical contact;

a retaining ring comprising two half-sections joined by an integral hinge means, said ring having first and second retention means;

said first retention means comprising at least one protuberance extending radially inward from said retaining ring into engagement with said insert member to maintain the insert member in fixed position within said ring;

said second retention means comprising at least one cantilevered resilient arm formed integrally with said ring, each arm having a lip adjacent its distal extremity for engaging the shell shoulder to thereby maintain said insert member and said ring within the shell;

each said arm being biased radially outward by the elastomeric insert member to assure engagement between said lip and said shoulder;

a passageway providing access to said second retention means to permit inward movement of said arm extremity and to permit disengagement of said lip from said shoulder; and means on said ring for maintaining both said ring and insert member in fixed rotational orientation within said shell.

16. A connector assembly with a predetermined polarity comprising:

a shell;

an elastomeric insert member for supporting at least one electrical contact;

a retaining ring including means for retaining the insert member in a fixed predetermined position within said ring and means for keying said ring to said shell, said retaining means and said keying means cooperating to establish the predetermined connector assembly polarity, said retaining ring further including a plurality of radially movable axially extending arms for engaging said shell to maintain said ring and insert member in fixed axial position within said shell.

* * * * *